US012345128B2

(12) United States Patent
Maher et al.

(10) Patent No.: US 12,345,128 B2
(45) Date of Patent: Jul. 1, 2025

(54) DOWNHOLE DEBRIS REMOVAL APPARATUS

(71) Applicant: Halliburton Energy Services, Inc., Houston, TX (US)

(72) Inventors: Peter Reid Maher, Lafayette, LA (US); Todd J. Roy, Lafayette, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/305,217

(22) Filed: Apr. 21, 2023

(65) Prior Publication Data

US 2024/0352828 A1 Oct. 24, 2024

(51) Int. Cl.
*E21B 37/00* (2006.01)
*E21B 31/00* (2006.01)

(52) U.S. Cl.
CPC ..... *E21B 37/00* (2013.01); *E21B 31/007* (2013.01)

(58) Field of Classification Search
CPC ..... E21B 37/00
See application file for complete search history.

(56) References Cited

U.S. PATENT DOCUMENTS

| | | | | |
|---|---|---|---|---|
| 3,326,305 | A * | 6/1967 | Garrett | E21B 7/062 175/81 |
| 11,466,542 | B2 | 10/2022 | Roy et al. | |
| 2010/0288485 | A1* | 11/2010 | Blair | E21B 29/002 166/99 |
| 2013/0014956 | A1 | 1/2013 | Hughes et al. | |
| 2016/0245033 | A1 | 8/2016 | Krpec | |
| 2018/0252050 | A1* | 9/2018 | Veit | E21B 17/03 |
| 2019/0345776 | A1 | 11/2019 | Farrar et al. | |
| 2020/0080389 | A1 | 3/2020 | Getzlaf et al. | |
| 2022/0195844 | A1* | 6/2022 | Roy | E21B 23/00 |

OTHER PUBLICATIONS

"PCT Application No. PCT/US2023/066128, International Search Report and Written Opinion", Jan. 11, 2024, 11 pages.

* cited by examiner

*Primary Examiner* — William D Hutton, Jr.
*Assistant Examiner* — Avi T Skaist
(74) *Attorney, Agent, or Firm* — DeLizio, Peacock, Lewin & Guerra, LLP

(57) ABSTRACT

A wellbore debris removal apparatus comprises a crossover sub having a first sub end and a second sub end, wherein the crossover sub includes at least one slotted mechanism and includes a fluid passageway extending from the first sub end to the second sub end. The wellbore debris removal apparatus comprises a debris removal tube having at least one lug and a tube end to be placed in the crossover sub such that the debris removal tube is engaged with the at least one slotted mechanism of the crossover sub via the at least one lug.

14 Claims, 7 Drawing Sheets

DOWNHOLE DEBRIS REMOVAL APPARATUS

BACKGROUND

Well operations, such as milling out a tool or pipe in a wellbore or a frac operation, create debris that needs to be collected and removed from the well. For example, a bottom-hole assembly with a mill is made up with a debris collection tool. Debris collection tools are sometimes referred to as junk baskets, collector baskets or debris screens. There are a variety of different collection tools that operate on different principles. However, in general, these various tools have a common objective of separating circulating fluid from the cuttings and/or other debris that is present in the wellbore. In some tools, reverse circulation is created at the lower end of the tubing string and is used to circulate; the debris into a collection tool, Reverse circulation is generally created by using a tool, sometimes referred to as a venturi device (e.g., power head), to direct flow laden with cuttings and/or particulate material into a debris removal assembly.

BRIEF DESCRIPTION OF THE DRAWINGS

Embodiments of the disclosure may be better understood by referencing the accompanying drawings.

DESCRIPTION

Figure 1:
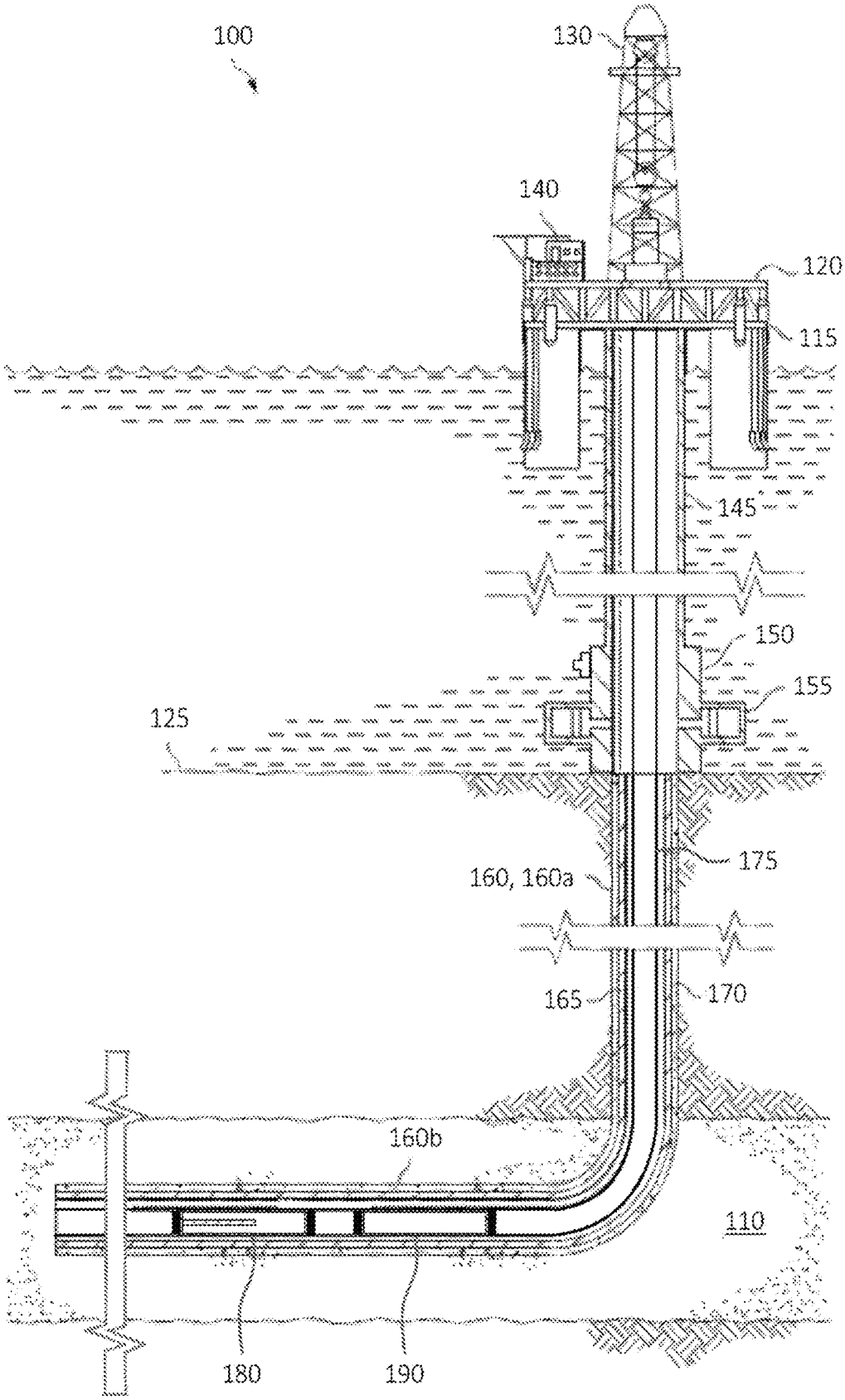
FIG. 1 is a conceptual diagram of a well system, according to some embodiments.

The description that follows includes example systems, methods, techniques, and program flows that embody aspects of the disclosure. However, it is understood that this disclosure may be practiced without these specific details. In other instances, well-known instruction instances, protocols, structures, and techniques have not been shown in detail in order not to obfuscate the description.

Example embodiments may include a debris removal assembly for use in a wellbore. The debris removal assembly may include a crossover sub and a debris removal tube. In some implementations, the crossover sub may be positioned between two sections of drill pipe. Some embodiments may include the use of at least one lug and at least one slotted mechanism to lock the debris removal tube to the crossover sub. Such embodiments are in contrast to conventional approaches that include a threading of the debris removal tube into the crossover sub. These conventional approaches may be difficult to use on a well rig floor where space is limited. Additionally, these conventional approaches may be difficult and time consuming on a well rig floor with drill pipe in a rat hole or in a rotary table.

In contrast, example embodiments may include lugs and a slotted mechanism (such as a J slot) to lock the debris removal tube to the crossover sub. Such example embodiments may include a part that may not be load bearing. Thus, such embodiments may be sufficient to hold components together during the downhole operations. Also, in contrast to conventional approaches, example embodiments may be much easier to assemble. Additionally, example embodiments may include assembly that may be performed horizontally (such as at the pipe deck) or vertically (such as at the rotary table or rat hole). Thus, example embodiments may include an engagement between a debris removal tube and a crossover sub for easier management of equipment on the rig.

Accordingly, example embodiments may include a drill pipe collection chamber that may greatly reduce cost and maintenance of equipment compared to maintaining existing collection chambers. Such a drill pipe collection chamber may allow for a lower cost entry into the market without loss of functionality. Being able to manage, handle, assemble and disassemble quickly and easily on the rig provides further operational advantages over conventional approaches.

Example implementations may lock a debris removal tube with a crossover sub using at least one lug of the debris removable tube and at least one slotted mechanism of the crossover sub. Such implementations may allow for flow uphole (not impacting the slotted mechanism). Additionally, flow from downhole would enable the locking of the slotted mechanism to remain in place (as further described below).

In some implementations, for vertical assembly, a manual overshot may be used to lower the debris removal tube into place. A pulling upward may verify that the debris removal tube has properly locked in place before releasing overshot. In some embodiments, the slotted mechanism may be built into a removable sleeve that may be installed into the crossover sub. Such embodiments would not require machining of the slotted mechanism into an inner diameter of the crossover sub. In some implementations, instead of or in addition to lugs, spring loaded detent pins may be installed into the crossover sub and holes for these pins may be included in the debris removal tube for retention. In such implementations, the slotted mechanism may include a V shaped guide.

Example System

FIG. 1 is a conceptual diagram of a well system, according to some embodiments. FIG. 1 includes a well system 100 having a downhole debris removal apparatus 180. The well system 100 may include a semi-submersible platform 115 having a deck 120 positioned over a subterranean (e.g., oil and gas) formation 110 that is located below a sea floor 125. The platform 115 may include a hoisting apparatus/derrick 130 for raising and lowering various oil and gas components, such as conveyances, work string, production tubing, etc. The well system 100 may additionally include a control system 140 located on the deck 120, or elsewhere. The control system 140 may be used to control various different aspects of the well system 100.

A subsea conduit 145 extends from the platform 115 to a wellhead installation 150, which may include one or more subsea blow-out preventers 155. A wellbore 160 extends through the various earth strata including the subterranean formation 110. In this example, a wellbore casing 165 may be cemented within the wellbore 160 by cement 170. A conveyance 175 may be positioned withing the wellbore casing 165. The conveyance 175 may be any known conveyance (such as a work string, a production string, etc.).

In this example, the wellbore 160 has an initial, generally vertical portion 160*a* and a lower, generally deviated portion 160*b*, which is illustrated as being horizontal. It should be noted by those skilled in the art, however, that the downhole debris removal apparatus 180 may be equally well-suited for use in other well configurations including, but not limited to, inclined wells, wells with restrictions, non-deviated wells and the like. Moreover, while the wellbore 160 is positioned below the sea floor 125 in the illustrated embodiment of FIG. 1, example embodiments may be applicable to other subterranean formations, including those encompassing both areas below exposed earth.

In some implementations, the downhole debris removal apparatus 180 may include a crossover sub and a debris removal tube. The crossover sub may include a first sub end and a second sub end. Additionally, the crossover sub may include a fluid passageway extending from the first sub end to the second sub end. The crossover sub may also include at least one slotted mechanism (such as a J slot, a V shaped guide, etc.). In some implementations, if the crossover sub includes two slotted mechanisms, one slotted mechanism may be 180 degrees offset from the other. In some implementations, the crossover sub may include a removable sleeve that includes the at least one slotted mechanism.

The debris removal tube may be configured to engage with the at least one slotted mechanism. For example, the debris removal tube may include at least one lug such that the at least one slotted mechanism may guide the at least one lug into a locking position. In some implementations, if the debris removal tube includes two lugs, one lug may be 180 degrees offset from the other. In some implementations, the debris removal tube may include at least centralizer. The debris removal tube may also include a fishing head for vertical assembly.

In some implementations, the at least one slotted mechanism may include a V shaped guide, wherein the crossover sub may include at least one detent pin positioned on the inside of the crossover sub. In such implementations, the debris removal tube may include at least one hole into which the at least one detent pin is positioned after the debris removal tube is engaged with the crossover sub. Additionally, in such implementations, the debris removal tube may include at least one lug for guidance.

The downhole debris removal apparatus 180 may include a downhole tubular engaged with the crossover sub and surrounding the debris removal tube. The downhole tubular may have a first tubular end with a tubular pin thread engaging the sub box thread of the crossover sub and a second tubular end with a tubular box thread. The downhole tubular may be a drill string having a pin thread at one end and a box thread at the other end. In some implementations, the downhole tubular may be a casing string having a pin thread at one end and a box thread at the other end. In other implementations, the downhole tubular is tubing string having a pin thread at one end and a box thread at the other end.

A venturi device (e.g., power head) 190 may be coupled to the downhole debris removal apparatus 180 (e.g., positioned uphole of the downhole debris removal apparatus 180). The venturi device 190 may be operable to provide fluid circulation through the downhole debris removal apparatus 180.

Example Wellbore Debris Removal Apparatus

Figure 2:
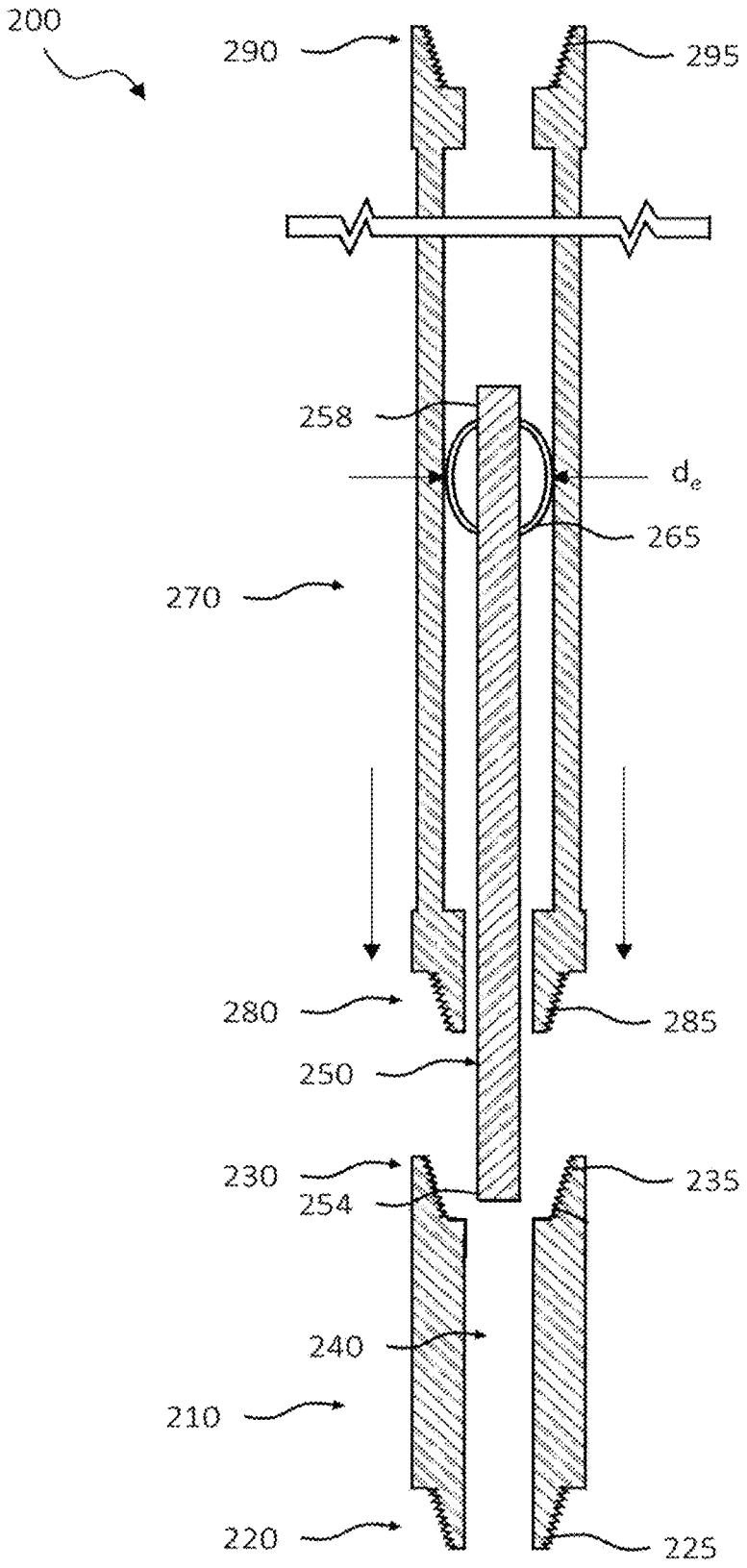
FIG. 2 is a diagram of a cross-sectional view of a wellbore tubular and a wellbore debris removal apparatus that includes a crossover sub and a debris removal tube, according to some embodiments.

FIG. 2 is a diagram of a cross-sectional view of a wellbore tubular and a wellbore debris removal apparatus that includes a crossover sub and a debris removal tube, according to some embodiments. FIG. 2 includes a wellbore debris removal apparatus 200.

The wellbore debris removal apparatus 200 may include a crossover sub 210. The crossover sub 210 may have a first sub end 220 with one of a sub pin thread or sub box thread, a second sub end 230 with the other of the sub box thread or sub pin thread, and a fluid passageway 240 extending from the first sub end 220 to the second sub end 230. In this example, the first sub end 220 includes a sub pin thread 225, and the second sub end 230 includes a sub box thread 235. Nevertheless, the opposite could apply, wherein the first sub end 220 would include a sub box thread and the second sub end 230 would include a sub pin thread.

The wellbore debris removal apparatus 200 additionally includes a debris removal tube 250 removably engaged with the crossover sub 210. The debris removal tube 250 may have a first tube end 254 and a second tube end 258. In this example, the first tube end 254 is removably engaged with the crossover sub 210 between the first sub end 220 and the second sub end 230, and the second tube end 258 is uncapped. As further described below, the debris removal tube 250 may be engaged with the crossover sub 210 using at least one slotted mechanism of the crossover sub 210 and at least one lug of the debris removal tube 250.

In some implementations, the debris removal tube 250 may include two or more centralizers 265 extending radially outward therefrom. In some embodiments, the two or more centralizers 265 are not rigid in nature, but move between a radially retracted state and a radially extended state. For example, the two or more centralizers 265 might be in the radially retracted state as they move through the neck of a tool joint of a downhole tubular but be in the radially extended state once they move past the neck of the tool joint of the downhole tubular. A diameter (de) of the two or more centralizers 265 in the radially extended state and a diameter (dr) of the two or more centralizers 265 in the radially retracted state may vary greatly and remain within example embodiments. In some implementations, the diameter (de) of the two or more centralizers 265 in the radially extended state may be at least 110 percent of a diameter (dr) of the two or more centralizers 265 in the radially retracted state. In some other implementations, the diameter (de) of the two or more centralizers 265 in the radially extended state is at least 150 percent of a diameter (dr) of the two or more centralizers 265 in the radially retracted state.

A variety of different centralizers 265 may be used. For example where it is desirable for the two or more centralizers 265 to be able to move between the radially extended state and the radially retracted state, the centralizers 265 may be two or more bow springs. In other examples, the two or more centralizers 265 could be two or more fins that are urged radially outward by two or more related springs.

The wellbore debris removal apparatus 200 additionally may include a downhole tubular 270. The downhole tubular 270 is operable to engage with the crossover sub 210 and surround the debris removal tube 250. For example, the downhole tubular 270 may have a first tubular end 280 with a tubular pin thread 285 and a second tubular end 290 with a tubular box thread 295. In this example, the tubular pin thread 285 would engage the sub box thread 235 of the crossover sub 210, and thus couple the downhole tubular 270 with the crossover sub 210.

The downhole tubular 270, as indicated above, may be drill pipe or drill string. In some implementations, the downhole tubular 270 may be casing string or tubing string. Accordingly, the wellbore debris removal apparatus 200 may be modular in nature, and thus may be easily assembled at the well site or rig floor, for example as the features of the wellbore debris removal apparatus 200 may be easily handled and coupled using conventional rig tongs, elevators and slips. Moreover, in some implementations, the wellbore debris removal apparatus 200 does not need a handling sub, as is required in various other existing wellbore debris removal apparatus. In this example, the crossover sub 210, the debris removal tube 250 and the downhole tubular 270 may form at least a portion of a debris collection sub of the wellbore debris removal apparatus 200.

Figure 3:
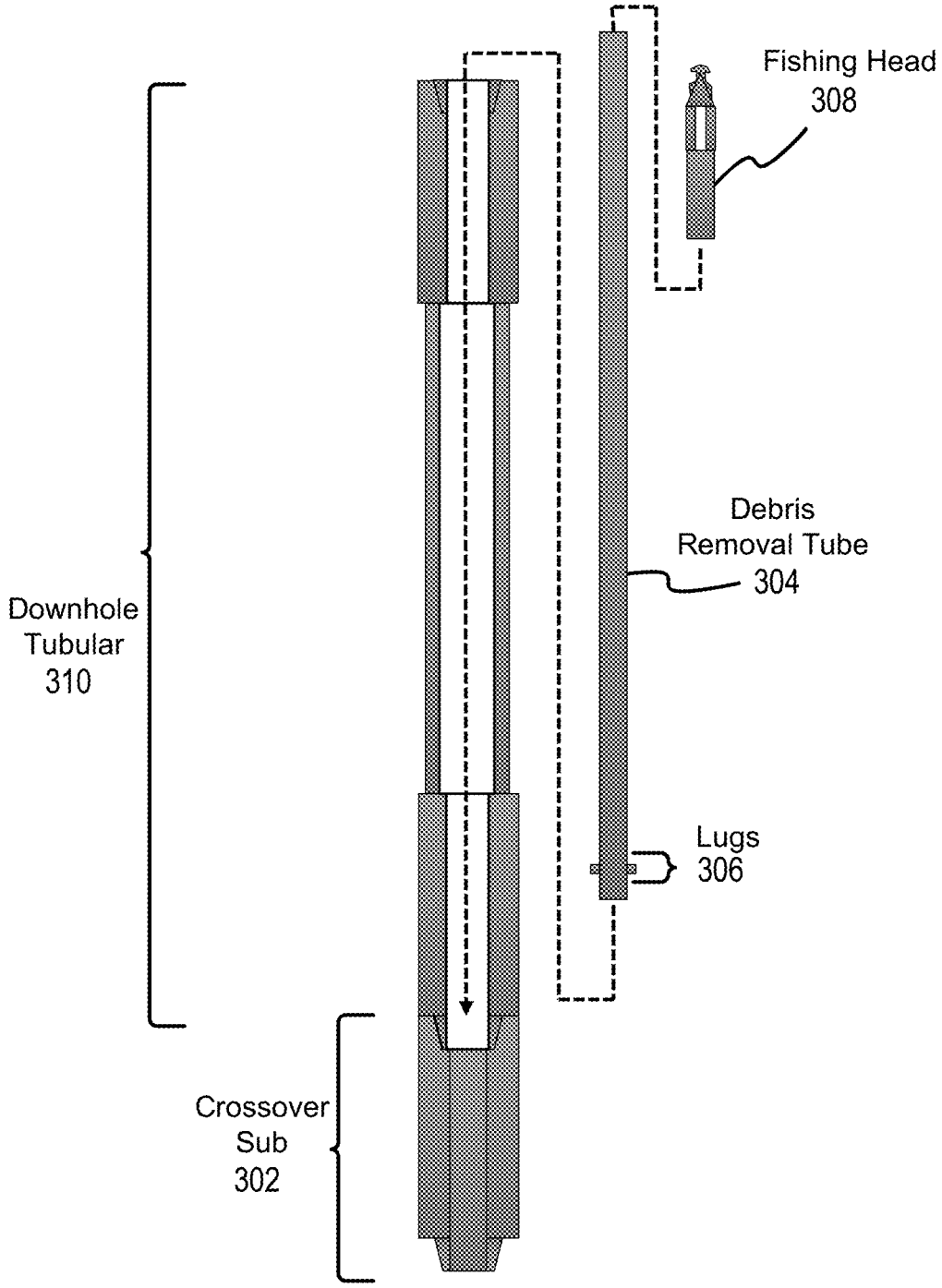
FIG. 3 is a diagram of a cross-sectional view of a wellbore debris removal apparatus that includes a crossover sub and a debris removal tube, according to some embodiments.

FIG. 3 is a diagram of a cross-sectional view of a wellbore debris removal apparatus that includes a crossover sub and a debris removal tube, according to some embodiments. FIG. 3 includes a wellbore debris removal apparatus that includes a crossover sub 302 and a debris removal tube 304. As further described below, the crossover sub 302 may include at least one slotted mechanism. The crossover sub 302 may be positioned between two sections of a downhole tubular (such as drill pipe). FIG. 3 includes a downhole tubular 310 that is coupled to a top end of the crossover sub 302. The debris removal tube 304 may include at least one lug 306. A fishing head 308 may be attached to an upper end of the debris removal tube 304 to assist during a vertical assembly of the wellbore debris removal apparatus.

Figure 4:
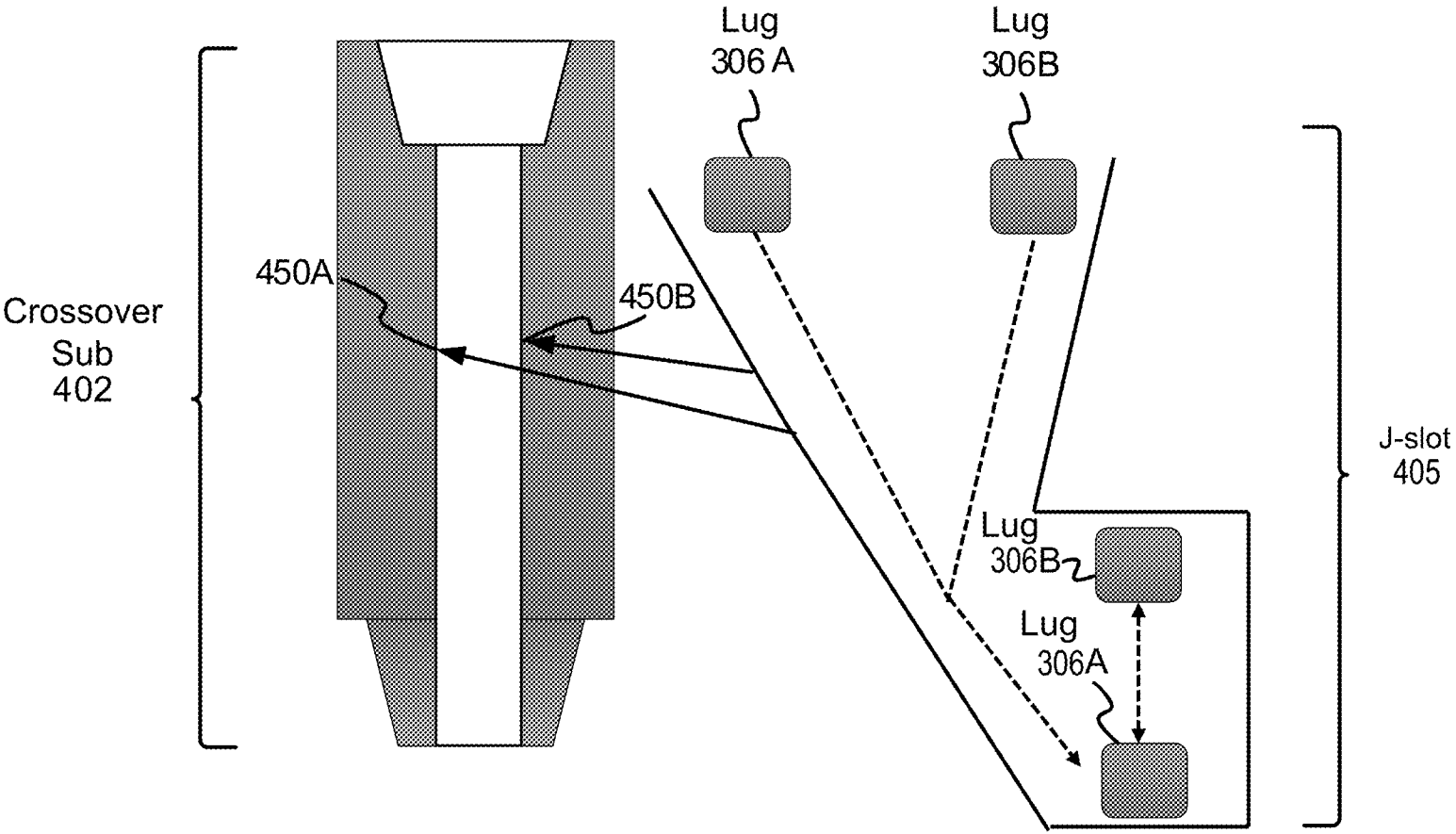
FIG. 4 is a more detailed diagram of a cross-sectional view of an example of the crossover sub of FIG. 3 that includes a J-slot, according to some embodiments.

FIG. 4 is a more detailed diagram of a cross-sectional view of an example of the crossover sub of FIG. 3 that includes a J-slot, according to some embodiments. FIG. 4 includes a crossover sub 402 that includes a J-slot 405. As shown, a first J-slot 405 may be located at a position 450A, and a second J-slot 405 may be located at position 450B. In some implementations, the first J-slot 405 can be 180 degrees offset from the second J-slot 405. Also, as shown, a lug 306A and a lug 306B may be slotted at the top of the J-slot 405 and moved into a locked position down in the J-slot 405.

Figure 5:
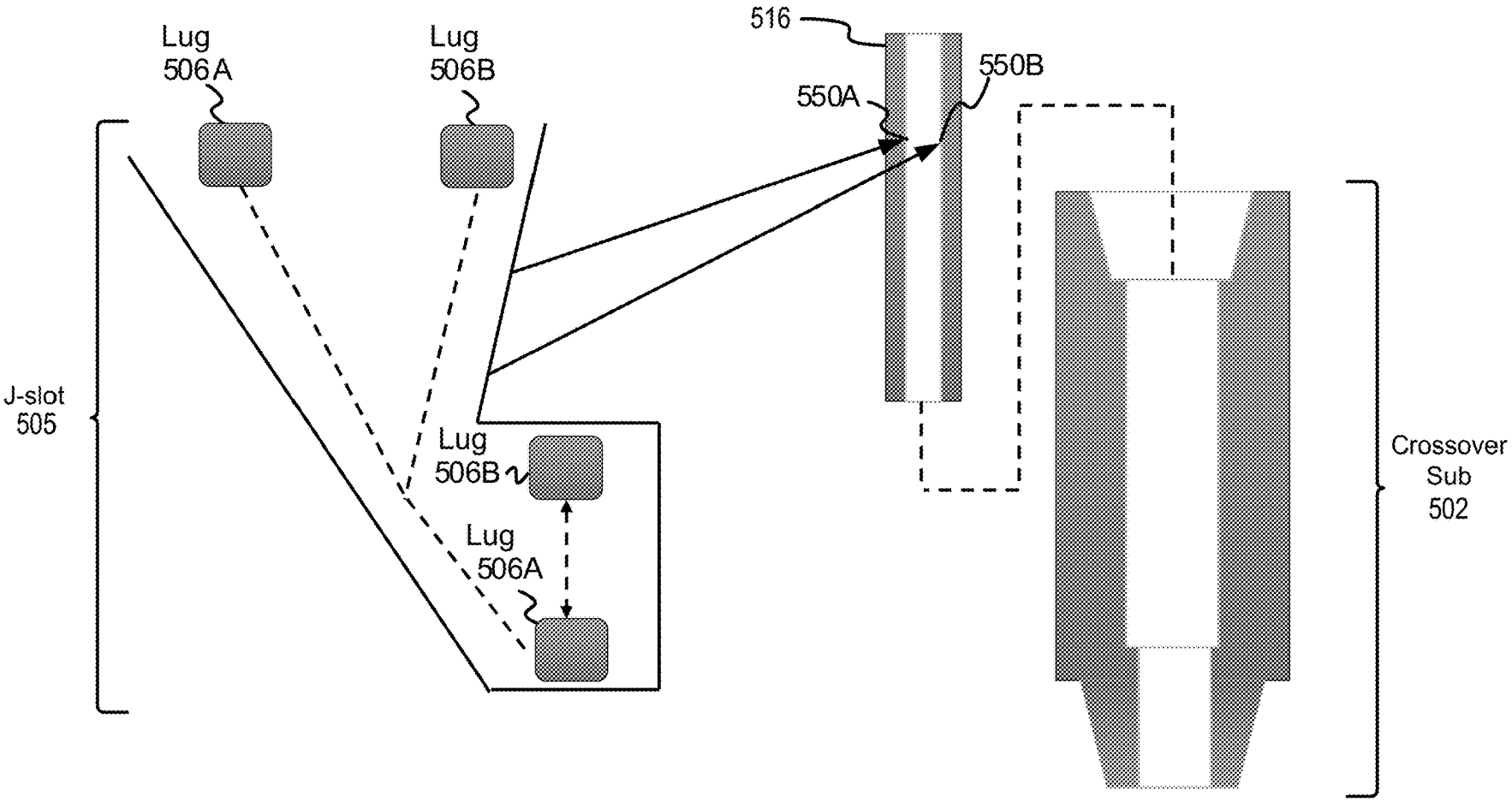
FIG. 5 is a more detailed diagram of a cross-sectional view of a wellbore debris removal apparatus that includes a crossover sub having a removable sleeve that includes a J-slot, according to some embodiments.

FIG. 5 is a more detailed diagram of a cross-sectional view of a wellbore debris removal apparatus that includes a crossover sub having a removable sleeve that includes a J-slot, according to some embodiments. FIG. 5 includes a wellbore debris removal apparatus that comprises a crossover sub 502 that includes a removable sleeve 516. As shown, the removable sleeve 516 may include a J-slot 505 on each side. The removable sleeve 516 with the J-slots 505 may be positioned within the crossover sub 502.

For example, a first J-slot 505 may be located at a position 550A, and a second J-slot 505 may be located at position 550B. In some implementations, the first J-slot 505 can be 180 degrees offset from the second J-slot 505. Also, as shown, a lug 506A and a lug 506B that are part of a debris removal tube can be slotted at the top of the J-slot 505 and moved into a locked position down in the J-slot 505. Such implementations include the J-slot 505 that may be built into the removable sleeve 516 and would not require that the J-slot 505 be machined into an inner diameter of the crossover sub 502.

Figure 6:
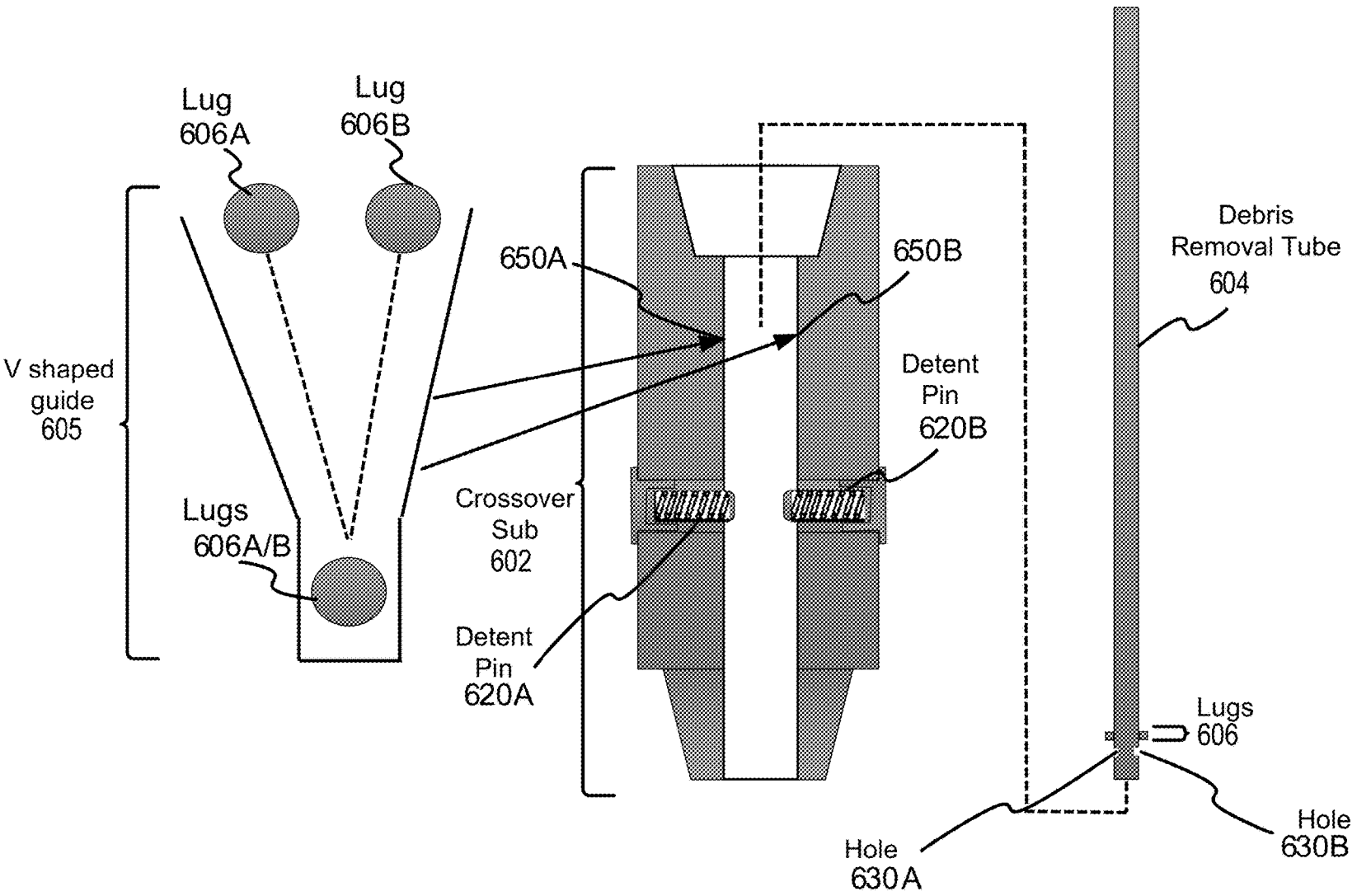
FIG. 6 is a more detailed diagram of a cross-sectional view of a wellbore debris removal apparatus that includes a crossover sub (having a V shaped guide and detent pins) and a debris removal tube, according to some embodiments.

FIG. 6 is a more detailed diagram of a cross-sectional view of a wellbore debris removal apparatus that includes a crossover sub (having a V shaped guide and detent pins) and a debris removal tube, according to some embodiments. FIG. 6 includes a wellbore debris removal apparatus that includes a crossover sub 602 and a debris removal tube 604.

As shown, the crossover sub 602 may include a V shaped guide 605 on each side (180 degrees relative to each other). The debris removal tube 604 may include lugs 606. For example, a first V shaped guide 605 may be located at a position 650A, and a second V shaped guide 605 may be located at position 650B. In some implementations, the first V shaped guide 605 can be 180 degrees offset from the second V shaped guide 605. Also, as shown, a lug 606A and a lug 606B that are part of a debris removal tube can be slotted at the top of the V shaped guide 605 and moved into a locked position down in the V shaped guide 605.

Additionally, the crossover sub 602 may include at least one detent pin. In FIG. 6, the crossover sub 602 includes detent pins 620A and 620B. Each of the detent pins 620A-620B may be spring loaded. The debris removal tube 604 may also include a hole that corresponds to each of the detent pins 620A-620B of the crossover sub 602. In this example, the debris removal tube 604 includes two holes—a hole 630A and a hole 630B.

The debris removal tube 604 may be positioned in the crossover sub 602 such that the lugs 606A-606B and the V shaped guide 605 are used to lock the debris removal tube 604 to the crossover sub 602. Additionally, the lugs 606A-606B guide the holes 630A-630B into the detent pins 620A-620B during assembly.

Example Operations

Figure 7:
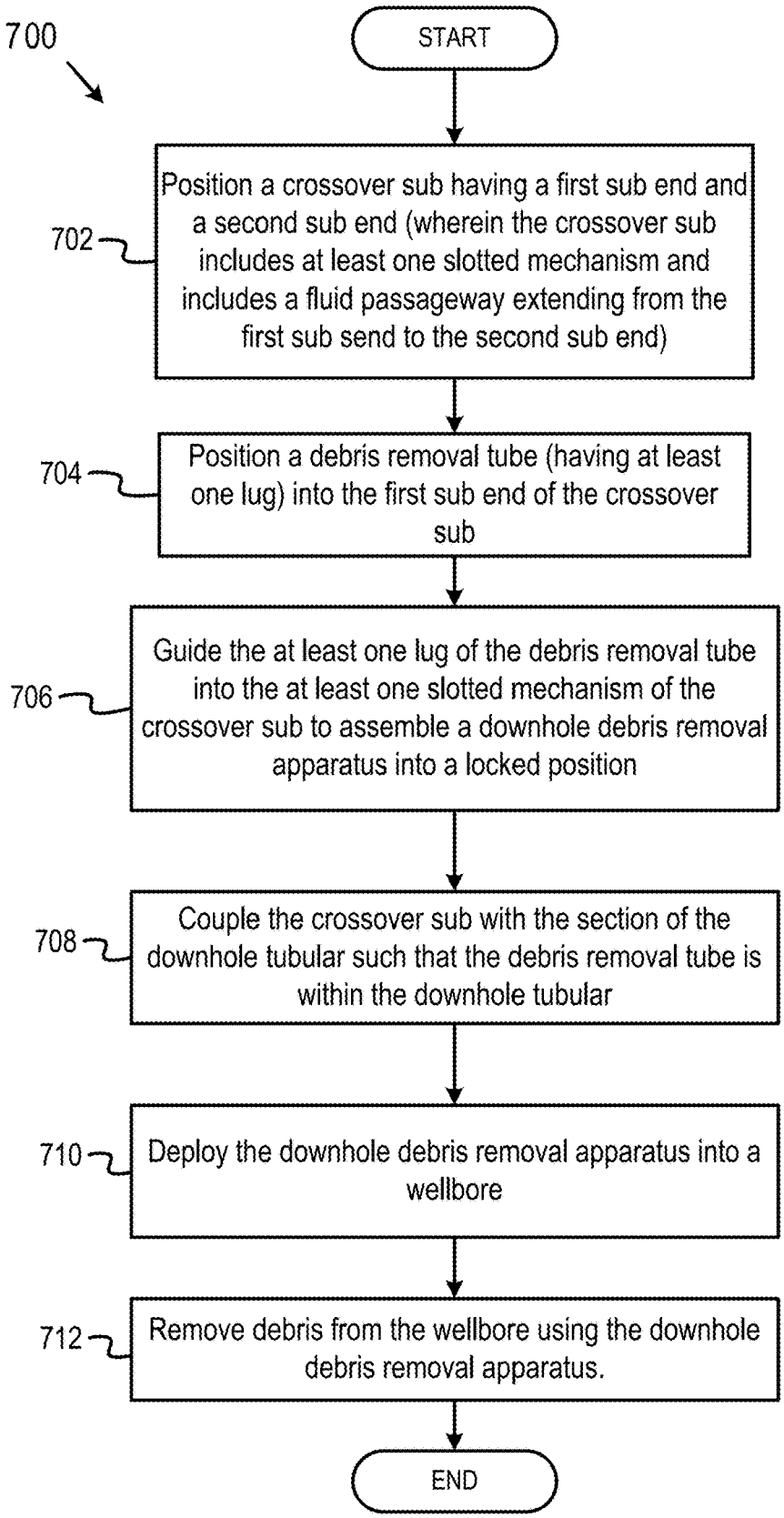
FIG. 7 is a block diagram of a flowchart of operations for assembling and using a wellbore debris removal apparatus, according to some embodiments.

FIG. 7 is a block diagram of a flowchart of operations for assembling and using a wellbore debris removal apparatus, according to some embodiments. A flowchart 700 of FIG. 7 is described in reference to the well system 100 of FIG. 1 and the wellbore debris removal apparatus (that includes a crossover sub and a debris removal tube) of FIGS. 2-3. Operations of the flowchart 700 start at block 702.

At block 702, a crossover sub having a first sub end and a second sub end is positioned (wherein the crossover sub includes at least one slotted mechanism and includes a fluid passageway extending from the first sub send to the second sub end). For example, with reference to FIG. 1, the crossover sub of the wellbore debris removal apparatus 180 may be placed in a position on the deck 120 of the well system 100 for assembly.

At block 704, a debris removal tube is positioned into the first sub end of the crossover sub. For example, with reference to FIG. 1, the debris removal tube of the wellbore debris removal apparatus may be positioned within the crossover sub on the deck of the well system 100. With reference to FIG. 3, the debris removable tube 304 may be positioned in the crossover sub 302.

At block 706, the at least one lug of the debris removal tube is guided into the at least one slotted mechanism of the crossover sub to assemble a downhole debris removal apparatus into a locked position. For example, with reference to FIGS. 3-4, the lugs 306A-306B of the debris removal tube 304 are guided into the J-slot 405 of the crossover sub 402.

At block 708, the crossover sub is coupled with the section of the downhole tubular such that the debris removal tube is within the downhole tubular. For example, with reference to FIG. 2, the crossover sub of the downhole debris removal apparatus 180 may be coupled to a downhole tubular 270, wherein the tubular pin thread 285 would engage the sub box thread 235 of the crossover sub 210 (thus coupling the downhole tubular 270 with the crossover sub 210).

At block 710, the downhole debris removal apparatus is deployed into a wellbore. For example, with reference to FIGS. 1-2, the crossover sub of the downhole debris removal apparatus 180 is deployed into the wellbore 160.

At block 712, debris from the wellbore is removed using the downhole debris removal apparatus. For example, with reference to FIG. 1, the venturi device 190 may be operable to provide fluid circulation through the downhole debris removal apparatus 180 to remove the debris from the wellbore. Operations of the flowchart 700 are complete.

Example Embodiments

Embodiment #1: A wellbore debris removal apparatus comprises a crossover sub having a first sub end and a second sub end, wherein the crossover sub includes at least one slotted mechanism and includes a fluid passageway extending from the first sub end to the second sub end; and a debris removal tube having at least one lug and a tube end to be placed in the crossover sub such that the debris removal tube is engaged with the at least one slotted mechanism of the crossover sub via the at least one lug.

Embodiment #2: The wellbore debris removal apparatus of Embodiment #1, wherein the at least one slotted mechanism comprises a J-slot.

Embodiment #3: The wellbore debris removal apparatus of any one of Embodiments #1-2, wherein the at least one slotted mechanism comprises a V shaped guide.

Embodiment #4: The wellbore debris removal apparatus of any one of Embodiments #1-3, wherein the at least one slotted mechanism comprises a first slot and a second slot.

Embodiment #5: The wellbore debris removal apparatus of Embodiment #4, wherein the first slot and the second slot are approximately 180 degrees away from each other on the crossover sub.

Embodiment #6: The wellbore debris removal apparatus of any one of Embodiments #1-5, wherein the crossover sub comprises a removable sleeve, wherein the removable sleeve includes the at least one slotted mechanism.

Embodiment #7: The wellbore debris removal apparatus of any one of Embodiments #1-6, wherein the debris removal tube comprises at least two centralizers to extend radially outward and to move between a radially retracted state and a radially extended state.

Embodiment #8: The wellbore debris apparatus of any one of Embodiments #1-7, wherein the debris removal tube comprises a fishing head attached at an end of the debris removal tube that is opposite of the tube end.

Embodiment #9: A method comprises positioning a crossover sub having a first sub end and a second sub end, wherein the crossover sub includes at least one slotted mechanism and includes a fluid passageway extending from the first sub end to the second sub end; positioning a debris removal tube having at least one lug into the first sub end of the crossover sub; and guiding the at least one lug of the debris removal tube into the at least one slotted mechanism of the crossover sub to assemble a downhole debris removal apparatus into a locked position.

Embodiment #10: The method of Embodiment #9, further comprises coupling the crossover sub with a section of a downhole tubular; and deploying the downhole debris removal apparatus into a wellbore.

Embodiment #11: The method of any one of Embodiments #9-10, further comprises removing debris from the wellbore using the downhole debris removal apparatus.

Embodiment #12: The method of any one of Embodiments #9-11, wherein the at least one slotted mechanism comprises a J-slot.

Embodiment #13: The method of any one of Embodiments #9-12, wherein the at least one slotted mechanism comprises a V shaped guide.

Embodiment #14: The method of any one of Embodiments #9-13, wherein the at least one slotted mechanism comprises a first slot and a second slot.

Embodiment #15: The method of any one of Embodiments #9-14, wherein the crossover sub comprises a removable sleeve, wherein the removable sleeve includes the at least one slotted mechanism.

Embodiment #16: A well system comprises a conveyance to be positioned in a wellbore; a downhole debris removal apparatus to be deployed down into the wellbore via the conveyance, wherein the downhole debris removal apparatus comprises, a crossover sub having a first sub end and a second sub end, wherein the crossover sub includes at least one slotted mechanism and includes a fluid passageway extending from the first sub end to the second sub end; and a debris removal tube having at least one lug and a tube end to be placed in the crossover sub such that the debris removal tube is engaged with the at least one slotted mechanism of the crossover sub via the at least one lug; a downhole tubular to be positioned in the wellbore and configured to be engaged with the crossover sub and to surround the debris removal tube; and a venturi device coupled to the downhole debris removal apparatus, the venturi device to provide fluid circulation through the downhole debris removal apparatus.

Embodiment #17: The well system of Embodiment #16, wherein the at least one slotted mechanism comprises a J-slot.

Embodiment #18: The well system of any one of Embodiments #16-17, wherein the at least one slotted mechanism comprises a V shaped guide, wherein the at least one slotted mechanism includes at least one detent pin, wherein the debris removable tube includes at least one hole into which the at least one detent pin is to be positioned after the debris removal tube is engaged with the at least one slotted mechanism.

Embodiment #19: The well system of any one of Embodiments #16-18, wherein the at least one slotted mechanism comprises a first slot and a second slot.

Embodiment #20: The well system of Embodiment #19, wherein the first slot and the second slot are approximately 180 degrees away from each other on the crossover sub.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A wellbore debris removal apparatus comprising:

a crossover sub having a first sub end and a second sub end, wherein the crossover sub includes at least one slotted mechanism and includes a fluid passageway extending from the first sub end to the second sub end, and wherein the crossover sub includes at least one detent pin; and a debris removal tube having at least one lug and a tube end to be placed in the crossover sub such that the debris removal tube is locked to the crossover sub via the at least one lug engaging with the at least one slotted mechanism of the crossover sub, wherein the at least one detent pin interacts with a corresponding hole on the debris removal tube when the debris removal tube is locked to the crossover sub.

2. The wellbore debris removal apparatus of claim 1, wherein the at least one slotted mechanism comprises a J-slot.

3. The wellbore debris removal apparatus of claim 1, wherein the at least one slotted mechanism comprises a V shaped guide.

4. The wellbore debris removal apparatus of claim 1, wherein the at least one slotted mechanism comprises a first slot and a second slot.

5. The wellbore debris removal apparatus of claim 4, wherein the first slot and the second slot are approximately 180 degrees away from each other on the crossover sub.

6. The wellbore debris removal apparatus of claim 1, wherein the crossover sub comprises a removable sleeve, wherein the removable sleeve includes the at least one slotted mechanism.

7. The wellbore debris removal apparatus of claim 1, wherein the debris removal tube comprises at least two centralizers to extend radially outward and to move between a radially retracted state and a radially extended state.

8. The wellbore debris removal apparatus of claim 1, wherein the debris removal tube comprises a fishing head attached at an end of the debris removal tube that is opposite of the tube end.

9. The wellbore debris removal apparatus of claim 1, wherein the at least one lug engaging with the slotted mechanism in the opposite direction as the at least one lug engaging with the slotted mechanism to lock the debris removal tube to the crossover sub is configured to unlock the debris removal tube from the crossover sub, and wherein the debris removal tube may be removed from the crossover sub when the debris removal tube is unlocked from the crossover sub.

10. A well system comprising:

a conveyance to be positioned in a wellbore;

a downhole debris removal apparatus to be deployed down into the wellbore via the conveyance, wherein the downhole debris removal apparatus comprises, a crossover sub having a first sub end and a second sub end, wherein the crossover sub includes at least one slotted mechanism and includes a fluid passageway extending from the first sub end to the second sub end, and wherein the crossover sub includes at least one detent pin; and a debris removal tube having at least one lug and a tube end to be placed in the crossover sub such that the debris removal tube is locked to the crossover sub via the at least one lug engaging with the at least one slotted mechanism of the crossover sub, wherein the one or more detent pins interact with a corresponding hole on the debris removal tube when the debris removal tube is locked to the crossover sub;

a downhole tubular to be positioned in the wellbore and configured to be engaged with the crossover sub and to surround the debris removal tube; and a venturi device coupled to the downhole debris removal apparatus, the venturi device configured to provide fluid circulation through the downhole debris removal apparatus.

11. The well system of claim 10, wherein the at least one slotted mechanism comprises a J-slot.

12. The well system of claim 10, wherein the at least one slotted mechanism comprises a V shaped guide, wherein the at least one detent pin is configured to be positioned in the corresponding hole after the debris removal tube is engaged with the at least one slotted mechanism.

13. The well system of claim 10, wherein the at least one slotted mechanism comprises a first slot and a second slot.

14. The well system of claim 13, wherein the first slot and the second slot are approximately 180 degrees away from each other on the crossover sub.

* * * * *